United States Patent [19]

Peters et al.

[11] Patent Number: 4,661,806

[45] Date of Patent: Apr. 28, 1987

[54] COMPUTER CONTROLLED KEY MANAGEMENT SYSTEM

[76] Inventors: Gilbert A. Peters, 1608 Lake Hill La.; J. Brooks Mitchell, 1805 Lakeshore La., both of Plano, Tex. 75023

[21] Appl. No.: 733,224

[22] Filed: May 10, 1985

[51] Int. Cl.[4] ..... G08B 13/14

[52] U.S. Cl. ..... 340/568; 70/456 R; 211/13; 340/572

[58] Field of Search ..... 340/568, 572, 525, 521, 340/518; 116/DIG. 41, 307, 306, 325, 1; 40/606, 612, 10 R, 2 A; 70/465 R; 211/13, 10

[56] References Cited

U.S. PATENT DOCUMENTS

| | | | |
|---|---|---|---|
| 700,985 | 1/1905 | Fossum | 70/456 R |
| 1,742,542 | 1/1930 | Howell | 211/13 |
| 2,405,369 | 8/1946 | Poulsen et al. | 312/189 |
| 2,485,051 | 10/1949 | Joslin | 70/456 |
| 2,886,396 | 5/1959 | Anthony et al. | 312/308 |
| 2,889,050 | 6/1959 | Modrey | 211/4 |
| 3,265,245 | 8/1966 | Harden | 221/124 |
| 3,648,241 | 3/1972 | Naito et al. | 340/147 |
| 3,659,154 | 4/1972 | Finn | 317/134 |
| 4,042,918 | 8/1977 | Klitzman | 340/568 |
| 4,159,783 | 7/1979 | Crasnianski | 221/13 |
| 4,205,328 | 5/1980 | Gotanda | 340/521 |
| 4,267,942 | 5/1981 | Wick, Jr. et al. | 221/2 |
| 4,549,170 | 10/1985 | Serres et al. | 340/568 |
| 4,595,922 | 6/1986 | Cobb et al. | 340/568 |

FOREIGN PATENT DOCUMENTS

| | | |
|---|---|---|
| 0030413 | 6/1981 | European Pat. Off. . |
| 0017931 | 2/1983 | European Pat. Off. . |
| 0006403 | 1/1984 | European Pat. Off. . |
| 2146154 | 4/1985 | United Kingdom . |
| 2135487 | 8/1985 | United Kingdom . |

*Primary Examiner*—Glen R. Swann, III

*Attorney, Agent, or Firm*—Hubbard, Thurman, Turner & Tucker

[57] ABSTRACT

A system for controlling access to several keys that includes several keyholders that include uniquely shaped portions that mate with correspondingly shaped portions of keyholder housings that are contained within a storage container. The storage container keyholder housings further include a latching apparatus for latching each of the keyholders such that the key and keyholders may not be removed unless an access signal is received by the latching apparatus. A data processor is connected to the storage means to receive inputs and provide access to selected keys in response to appropriate inputs. The data processor further records information such as time of access and access data. The storage keyholder housings further include circuitry that determine when a key has been replaced. The data processor is connected to receive the return information for recording. The data processor is further configured to provide output reports listing information as to access, return and usage. In another embodiment, a system is provided for controlling access to several keys that includes keyholders having unique identification codes that are read by circuitry within a storage container or by the data processor. The system data processor controls access to the keys and records return of the keys via the keyholder identification code.

25 Claims, 25 Drawing Figures

COMPUTER CONTROLLED KEY MANAGEMENT SYSTEM

BACKGROUND OF THE INVENTION

1. Field of the Invention

This invention relates to a management control system for controlling access to a set of individual keys and more particularly to a system that records the access and records the return of the keys.

2. Description of the Related Art

The use and control of many keys is common in certain businesses such as car dealerships, hotels, rental car agencies and the like. Systems used for the storage and distribution of keys generally compromises between four goals: security, control, convenience and cost. Employees or customers requiring access to facilities with moderate security requirements may typically have one or more keys issued to them for a long-term use. In this case no storage cabinet is involved but some means must be used to control and record distribution of the keys and also to record the return of the keys. While this method may be convenient for the employee, it often results in a proliferation of keys resulting in loss of control, weakened security and the requirement to replace the lost keys.

In the past storage racks, cabinets and pegboards have been used in an effort to enhance security and control but the usual result is an increase in cost, where an attendant is used to check keys in and out, and the convenience to the user is reduced. One storage device used in the past is disclosed in U.S. Pat. No. 2,886,396 to H. E. Anthony, et al, for a "Drawer For Storage Of Keys". Another device is disclosed in U.S. Pat. No. 3,405,369 to C. I. Paulsen, et al, and entitled "Safety Key Cabinet". Neither of these prior art inventions address the recording of distribution and return of the keys.

The object of this invention is to provide a key management system that results in increased security, control and convenience at lower cost.

SUMMARY OF THE INVENTION

In accordance with the present invention an apparatus for managing distribution of several similarly shaped objects is disclosed that includes a plurality of individual object holders each for attachment to at least one of the objects and each holder having a uniquely coded individual identification. The apparatus further includes a plurality of holder housings, each for controlling the storage of a holder and attached objects and including the capability to determine the identification of the holder and to provide access to the holder when properly selected.

In an embodiment of the present invention a system is provided for controlling access to several similarly shaped objects and includes a storage capability for storing several of the objects and for providing access to selected ones of the objects in response to an access signal and for providing a return signal when an accessed object is returned to the storage area. The storage area is connected to a data processor which includes an input circuit for receiving input data from a system user. The processor uses this input data together with previously stored data to determine whether access is to be granted. When access has been granted, the data processor transmits the access signal to the storage area. The data processor further includes receiving circuitry to receive the return signal from the storage area. The data processor is still further provided with the means to record the grant of access and the return of access together related data.

In another embodiment of the invention, a system for controlling access to several keys or the like is provided that includes a plurality of individual keyholders where each keyholder is attached to at least one key and further includes an individually coded mating capability for enabling the insertion of the keyholder and key into a keyholder housing having a corresponding individually coded mating structure. A storage container is provided that includes a plurality of the keyholder housings for controlled storage of the keys and keyholders by providing access to selected ones of the keyholders and keys in response to an access signal and further providing a return signal after the key and keyholder have been returned to the appropriate keyholder housing. The invention further includes input means for receiving inputs from a system user that would be requesting access to one of the selected keys. A display is also provided for providing output data to the system user. The input circuit and display are further connected to a processor which is further connected to one or more of the storage containers. The processor receives the input data and determines whether or not access is to be granted based upon the input data and previously stored data. Upon determining that access is to be granted, the processor provides the access signal. The processor further receives a return signal and includes means for storing data as to both the access and return of individual keys in keyholders.

The mating of the keyholders and keyholder housings is provided in one embodiment by pins and pin sockets whereby each keyholder has a unique number of pin sockets also uniquely positioned to fit only one corresponding set of pins of a keyholder housing in the storage container. Therefore the keyholder can only be inserted into the appropriate keyholder housing.

Another embodiment of this mating capability includes formations of tongues and grooves on the keyholder and the corresponding mating keyholder housing whereby the physical formation of the tongues and grooves are such that only the appropriate keyholder may be inserted into the appropriate keyholder housing.

In one embodiment, the keyholder housing includes a mechanical apparatus that is spring loaded when the keyholder is inserted and further connected to a microswitch and a solenoid. Upon receiving the access signal for that keyholder housing, the solenoid is activated causing the mechanism to release the keyholder which has been spring loaded, resulting in the keyholder being partially ejected from the keyholder housing. Further, when the keyholder is inserted into the keyholder housing, the mechanical apparatus loads the spring and the keyholder is latched into the keyholder housing activating the microswitch to provide the return signal.

In a still further embodiment, the processor generates an alarm any keyholders and keys are removed without appropriate grant of access.

In still another embodiment, an apparatus is provided for managing distribution of a plurality of keys that includes a plurality of keyholders each for the attachment to at least one of the keys and each keyholder having a uniquely individually coded identification. The apparatus further includes a plurality of holder housings, each for controlling the storage of a holder and attached keys. The holder housing includes electronic circuitry to read the identification of the holder and for providing access to the holder when properly selected. In this embodiment, the plurality of holder housings are included in a storage cabinet which includes the means to address each of the holder housings individually to determine the holder identification and to provide access thereto. In this embodiment, the holder includes an electronic circuit which provides the holder identification when addressed by external circuitry. In a different embodiment, the holder includes a magnetic coded strip to provide the holder identification. In a still further embodiment, the holder includes an optically encoded strip to provide holder identification.

BRIEF DESCRIPTION OF THE DRAWINGS

The novel features believed characteristic of this invention are set forth in the appended claims; however, this invention can be best understood by referencing the detailed description of the embodiment together with these drawings, wherein:

DETAILED DESCRIPTION OF THE INVENTION

The purpose of this invention is to provide a means for storage and controlled access to a large number of keys. As discussed in the background, often systems are necessary where keys are distributed and returned frequently to one location. An example of such an application would be in a car dealership where the salesmen would require convenient access to keys to different cars at different times. The present invention provides a means to place one or two keys in a keyholder and store the keyholders in a manner that access is provided in a controlled manner and further that access and return are both automatically recorded.

Figure 1A:
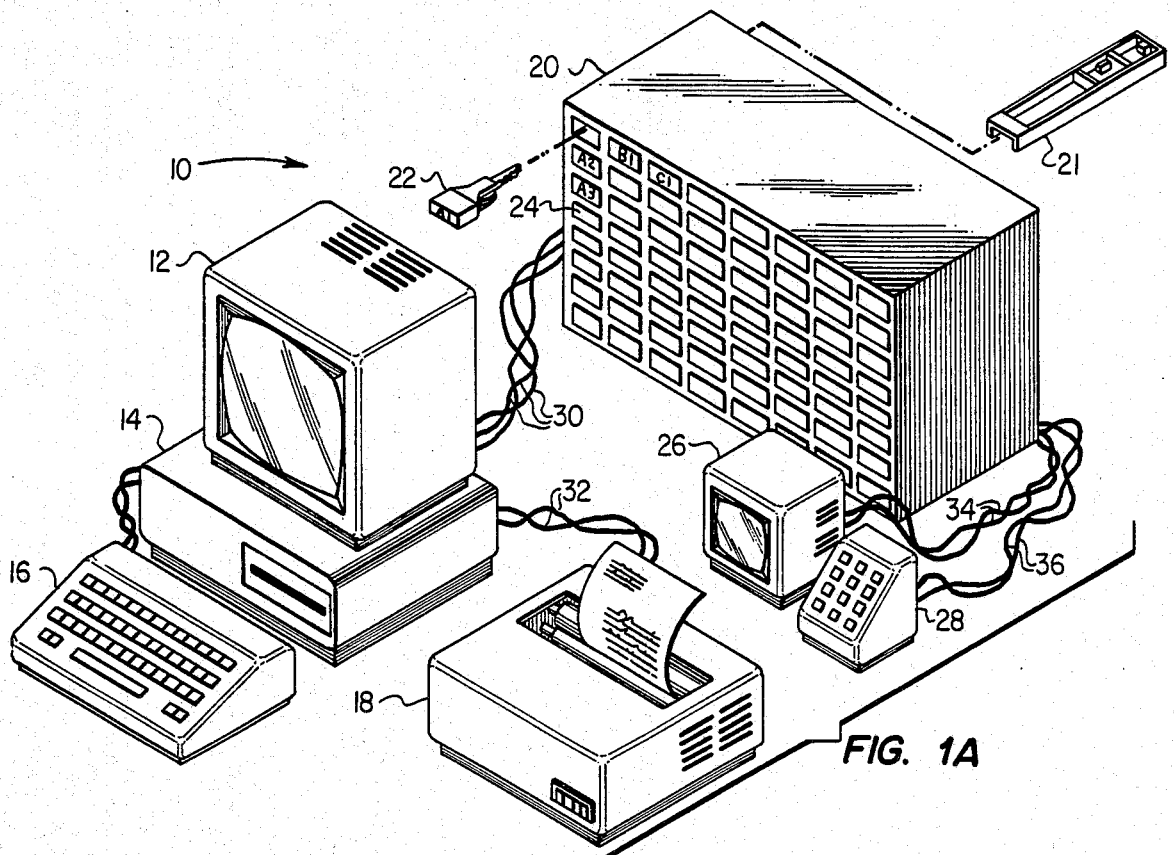
FIG. 1A is a pictorial view of the key management system.

FIG. 1A is a pictorial view of the key management system invention. Cabinet 20 contains several keyholders 22 which each contain one or more keys. The keyholders are inserted into keyholder housings 21 which are contained in individual slots 24 of the cabinet 20. The keyholders are sized to be larger than the largest key to be stored and is shaped to include two keys in the preferred embodiment. Further, the keyholder shape, size and mechanical features allow it and the keys to be (1) conveniently pocketed, (2) easily gripped by the user, and (3) easily used by providing room for one of the keys to be pivoted away allowing the other key to be inserted in a keyhole, and difficult to be mounted for machine duplication of the key because of the keyholder size and shape. When inserted, the keyholders 22 are totally enclosed by the keyholder housing 21 except for the open portion, thus making it difficult if not impossible to grasp the keyholder or withdraw it from the storage cabinet 20.

The system user would access keys in the storage cabinet 20 by the keypad 28 and display 26. The system user would normally input a personal identification number (PIN) together with the number of the keyholder and keys desired. Other information such as customer name, etc., may also be input. The display 26 would be used to display the prompts from the computer 14 together with any specific messages required. The keypad 28 is connected to the storage cabinet 20 via lines 36 and the display 26 is connected to the storage cabinet 20 via lines 34. The keypad 28 and display 26 would normally be located in the vicinity of the storage cabinet 20 such that the user would be able to quickly grasp the accessed key after access had been granted. The keypad 28 and display 26 may service more than one storage cabinet in an area.

The storage cabinet 20 is further connected via lines 30 to a system computer 14 that includes a keyboard 16, display 12 and printer 18. The printer is connected via lines 32 to the system computer 14. The system computer 14 serves as an overall manager of the cabinet 20, display 26 and keypad 28 and actually receives the inputs from the keypad 28, provides the displays to display 26 and further controls the access of the keys from the storage cabinet 20. Furthermore, the storage cabinet 20 includes circuitry to sense when a keyholder is present or absent. When a keyholder has been returned with the keys, a return signal is provided to the system computer 14 in order that the return of the key may be recorded. The printer 18 is provided for printing reports including information such as the located of keys and a history of key usage. The program contained in system computer 14 that manages the storage cabinet 20 will be contained internally in the computer memory or preferably in the mass storage device.

Customarily, the system computer 14 with its display 12, keyboard 16 and printer 18 would be located in a secure area where only a select few would have access. On the other hand the storage cabinet 20 with the keypad 28 and display 26 could be located in a public area since access to the storage cabinet 20 would be controlled. It should be understood that the system computer 14 may control several storage cabinets each having its own keyboard and display or several cabinets that may share various keyboards and displays.

Figure 1B:
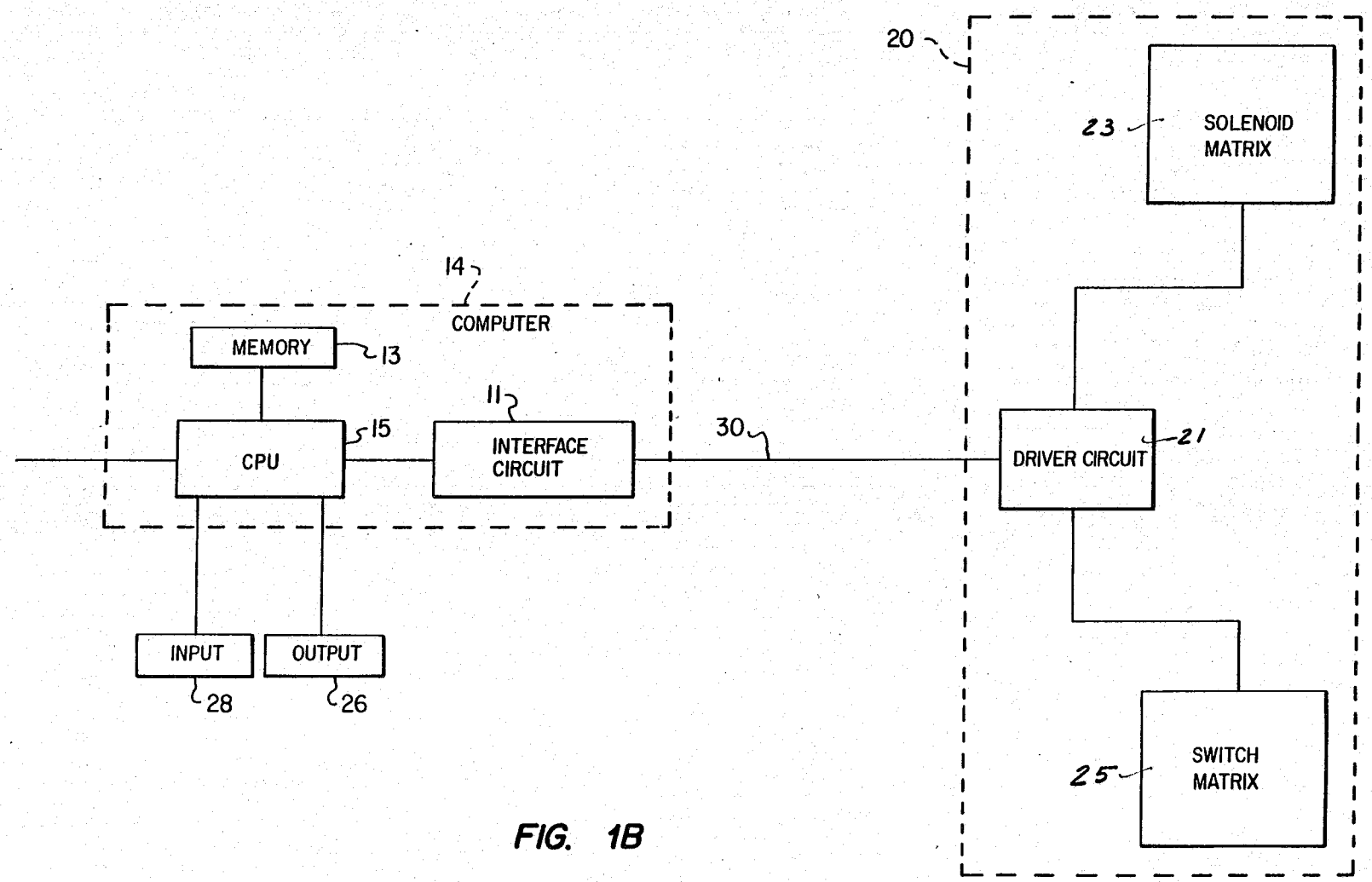
FIG. 1B is a block diagram of the key management system.

FIG. 1B illustrates a block diagram of the key management system. The computer 14 includes a memory 13, a central processing unit (CPU) 15 and an interface circuit 11. The CPU 15 is connected externally to the input keypad 28 and the output display 26 as previously discussed. The interface circuit 11 that is connected to CPU 15 is provided to send and receive the signals to cabinet 20 over lines 30. Cabinet 20 would include a driver circuit 21 to receive the signals from the computer to control a solenoid matrix 23 and a switch matrix 25. The keyholder housings for each of the keyholders would include a switch to record the insertion of the key and thus provide a means to determine when the keyholder and key had been returned. Likewise, the solenoid is provided in the keyholder housing to release the keyholder when access has been granted by the computer 14.

Figure 2:
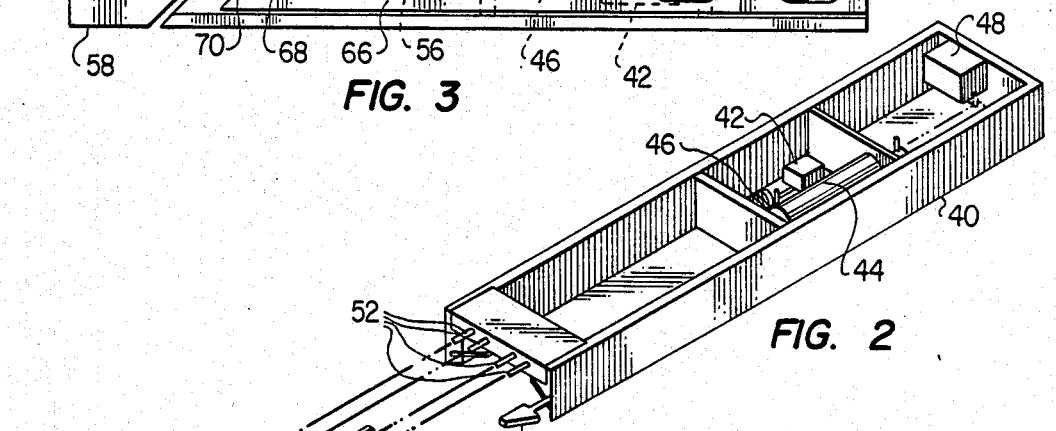
FIG. 2 is a perspective view of a keyholder and key with corresponding keyholder housing.

FIG. 2 is a perspective view of a keyholder housing 40 and keyholder 58. The keyholder 58 includes a key 56 secured by screw 60. In the preferred embodiment, the screw 60 is a tamper proof screw that may only be removed by a special tool such as a hex-hole tool corresponding to a hex-pin recess in the screw head. The keyholder 58 further includes pin sockets 54 that mate with pins 52. In the preferred embodiment, the number and position of pins 52 and pin holders 54 are unique amongst the keyholder housings 21 of the storage cabinet 20. In this manner only the appropriate keyholder 58 may be inserted into its keyholder housing 40 for storage. When keyholder 58 is inserted into the keyholder housing 40, it is held in place by a latch bar 50. Internal to the keyholder housing 40 is a solenoid 44, a spring 46, a microswitch 42, and an interface circuitry 48.

Figure 3:
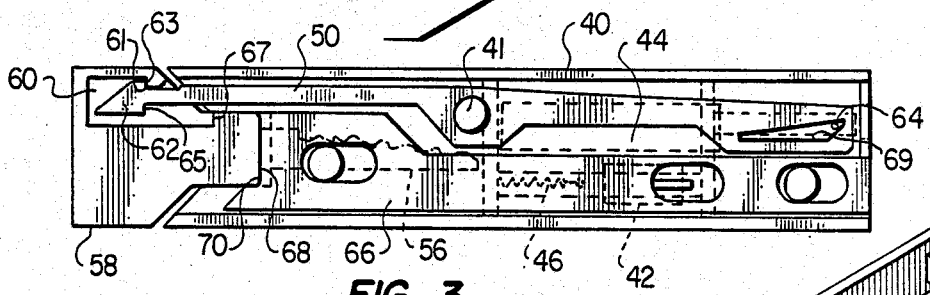
FIG. 3 is a bottom view of a keyholder assembled into its keyholder housing and latched.

FIG. 3 illustrates the keyholder 58 inserted into the keyholder housing 40. The keyholder 58 includes a recess 60 that is shaped to receive the front end 62 of the lever arm 50. When the keyholder 58 is inserted the lever arm front end 62 latches against the side of the recess 60 having lever surface 61 rest against the keyholder surface 63 to hold the keyholder 58 in place inside the keyholder housing 40. When keyholder 58 is inserted it pushes another lever arm 66. Keyholder surface 70 presses against surface 68 of the lever arm 66 which is mechanically connected to the spring 46 and a microswitch 42. The insertion of the keyholder 58 causes lever arm 66 to load spring 46 and place switch 42 in an off or open position. In this manner the keyholder 58 and keyholder housing 40 completely enclose the key 56. When microswitch 42 is switched as a result of keyholder 58 being inserted, a return signal is detected by the system computer that signifies that the keyholder 58 has been returned to its keyholder housing 40. It should be understood that if the mating pins 52 and holes 54 do not match, the keyholder may not be inserted into the keyholder housing 40 to the point that permits the lever arm 50 to engage the keyholder 58 or the microswitch 42 to be activated. After the keyholder 58 has been properly inserted, the keyholder may not again be removed until an access signal is received which powers solenoid 44 causing lever arm 50 to release the keyholder 58.

Figure 4:
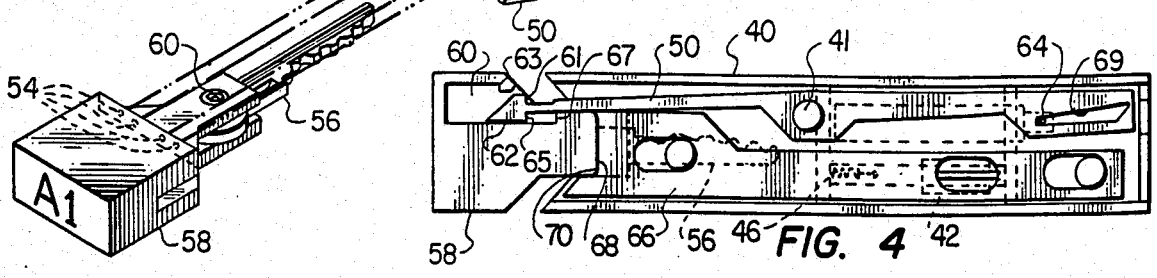
FIG. 4 is a bottom view of a keyholder released from its keyholder housing.

FIG. 4 is an illustration of the solenoid 44 activated causing the lever arm 50 to pivot about post 41 as a result of the movement of pin 64. Note that the front end 62 of the lever arm 50 has changed position in the keyholder recess area 60 and that lever arm 66 as a result of the compression of spring 46 ejects the keyholder 58 from the keyholder housing 40. When the access signal is received, solenoid 44 repositions pin 64 in slot 69 causing the lever 50 to rotate about post 41 and specifically resulting in lever surface 61 disengaging keyholder surface 63. Lever arm 66 which has been spring loaded during the keyholder 58 insertion, then ejects the keyholder 58. However lever 50 catches the keyholder 58 by engaging keyholder surface 67 with lever surface 65 keeping the keyholder 58 from completely ejecting from its keyholder housing 40. The lever 50 is held in this position for a short time by the energized solenoid 44. When the solenoid 44 is deenergized the keyholder may be easily grasped and removed by lateral movement in the keyholder housing 40.

In the preferred embodiment, solenoid 44 is a standard tubular pull-type from Guardian Electric Type No. T4X16-1-12VDC and the microswitch 42 is single pole, single throw, normally off, momentary contact push button key switch from Centralab Part No. 81F386.

Figure 5:
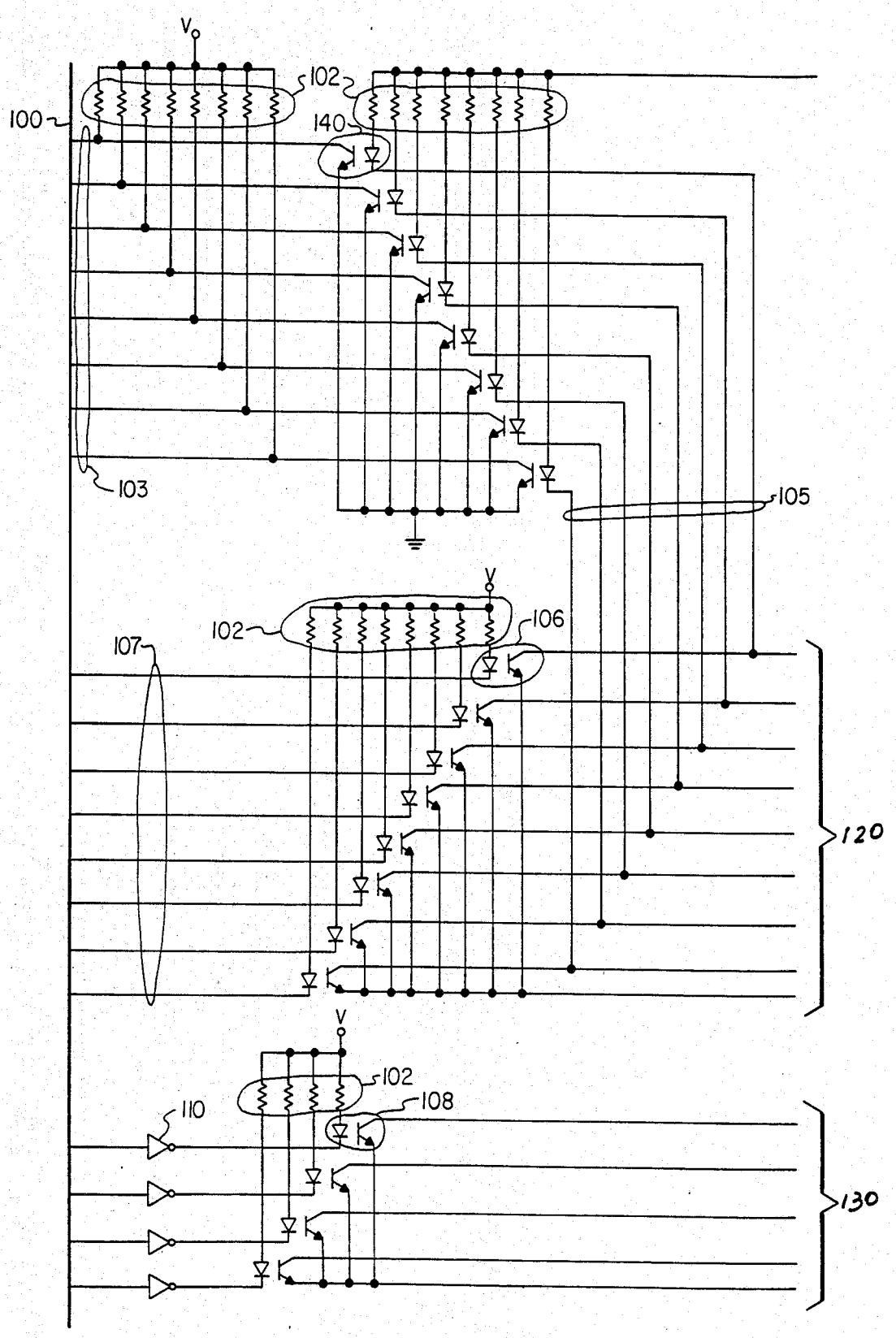
FIG. 5 is a schematic of the interface circuitry.

FIG. 5 is an illustration of the interface circuit 11 of FIG. 1B. In FIG. 5 eight address lines and one common line 120 are provided as signal inputs to cabinet 20 of FIG. 1. Four control signals and one common signal 130 are also provided. The interface circuit 11 is connected to the CPU 15 via bus 100. In the preferred embodiment bus 100 merely represents three eight bit output ports that receive program input/output signals from the CPU. Note that on the third output port, only four signals are required for the four control lines. The output array consists of lines 103 connected to pull-up resistors 102 and several optical isolator circuits 140. The optical isolator circuits are provided as a means of isolating the interface circuit 11 from the driver circuit 21. This is advantageous because, in the preferred embodiment, the driver circuit 21 uses a different driving voltage than the interface circuit 11. Thus the optical couplers 140, 106 and 108 provide electrical isolation of the interface circuit 11 from the driver circuit 21. The output of the optical couplers 140 and pull-up resistors 102 are provided on lines 105 to the driver circuit 21. Likewise, the inputs are received through optical couplers 106 which output through the pull-up resistors 102 onto lines 107 for inputting data into the computer. The control outputs of the computer are provided through inverters 110 pull-up resistors 102 through the optical couplers 108 on to lines 130.

Figure 6:
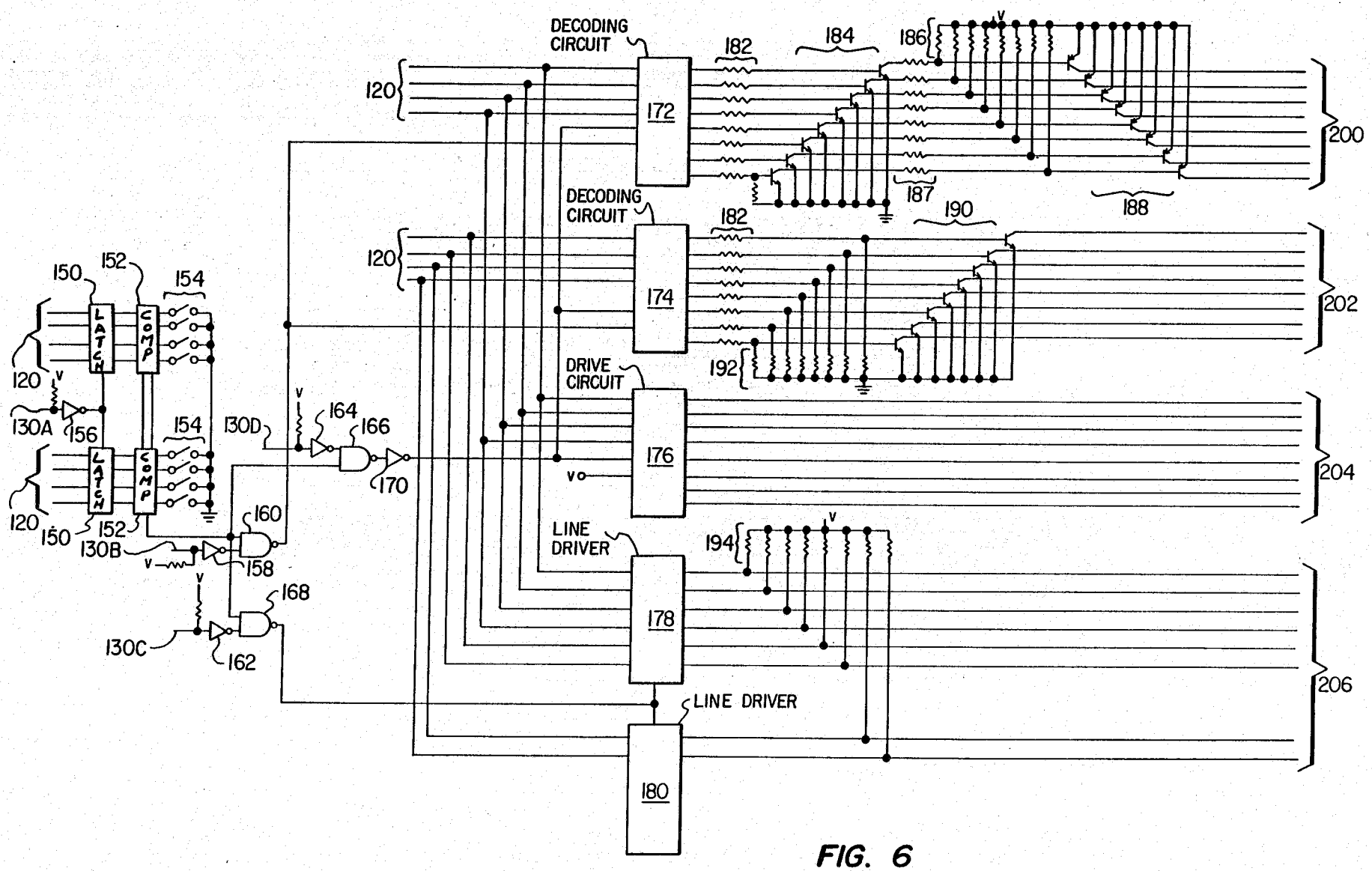
FIG. 6 is a schematic of the driver circuitry.

FIG. 6 is a schematic diagram of the driver card 21 of FIG. 1B. Each driver card is contained in a storage cabinet and includes switches 154 which are used to program that card's address or more specifically the address of the storage cabinet. The address data for the card is first received on lines 120 to latches 150 upon the occurrence of control signal 130A. The latched address is then compared in comparators 152 to the storage cabinet address input to switches 154. If the address matches, an output is provided to NAND gate 160 where it is NANDed with control signals 130B or 130C. Likewise, the specific keyholder housing is addressed on lines 120 which are also connected to the latching and decoding circuits 172 and 174. When a solenoid is to be activated, first the board or storage cabinet address is transmitted on lines 120 together with control signal 130A to latch the address into the latches 150. Secondly, a control signal 130B is provided with the keyholder housing address on lines 120. The output of comparators 152 and the control signal 130B through inverter 158 are combined in the NAND gate 160 to enable latch and decoding circuitries 172 and 174.

The outputs on lines 120 are then decoded by the circuitries 172 and 174 to provide one output on lines 200 and one output on lines 202. Specifically, the output on lines 200 is provided through an isolation resistor 182 and through transistor 184 through a second isolating resistor 187 pull-up resistors 186 through transistors 188 onto one of the lines on 200. Similarly, the output from the latch and decoding circuitry 174 is provided through one line to one of the isolation resistors 182 through one of the transistors 190 onto one of the lines of 202. These two lines are then used to activate the single addressed solenoid to release the keyholder as previously discussed.

The return microswitches are scanned by the keyholder housing circuitry in a similar manner to the decoding of the solenoid signal. Specifically, the address of the board or storage cabinet is decoded through comparators 152 which is combined with control signals 130D and 130C through the inverters 164 and 162, respectively, to NAND gates 166 and 168, respectively. The output of NAND gate 166 is coupled through inverter 170 to drive circuitry 176 which provides a drive output voltage V on one of the lines 204. Again, circuitry 176 is latch and decoding circuitry which decodes the address from lines 120. The signal from the keyholder housing switches is provided back to the driver card on lines 206 through pull-up resistors 194 into circuits 178 and 180 which are line drivers to provide the input signal back to the interface card.

Therefore, by the single eight bit data lines and the four control lines each keyholder housing solenoid and microswitch in the storage container may be individually addressed and controlled.

Figure 7A:
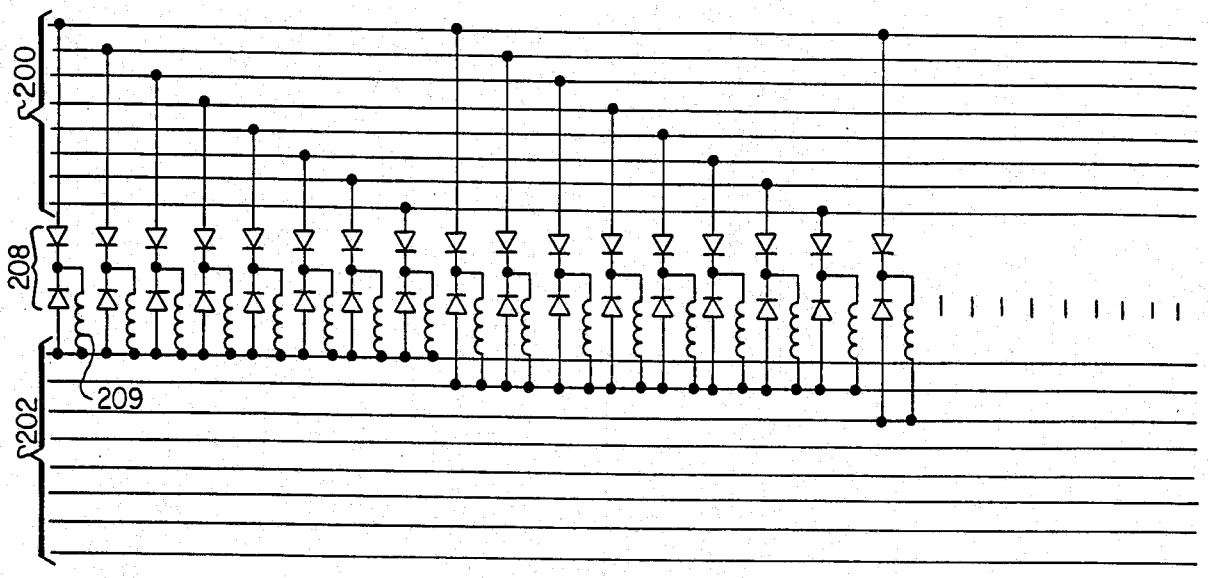
FIG. 7A is a schematic of the solenoid matrix.

FIG. 7A illustrates a portion of the matrix of solenoids for the keyholder housings of a storage container. The inputs on lines 200 and 202 are combined through two opposing diodes 208 into a coil representing the solenoid 209. In the preferred embodiment a positive signal is provided on one of lines 200 and the negative signal is provided on the corresponding lines 202 to activate the selected solenoid for releasing the keyholder.

Figure 7B:
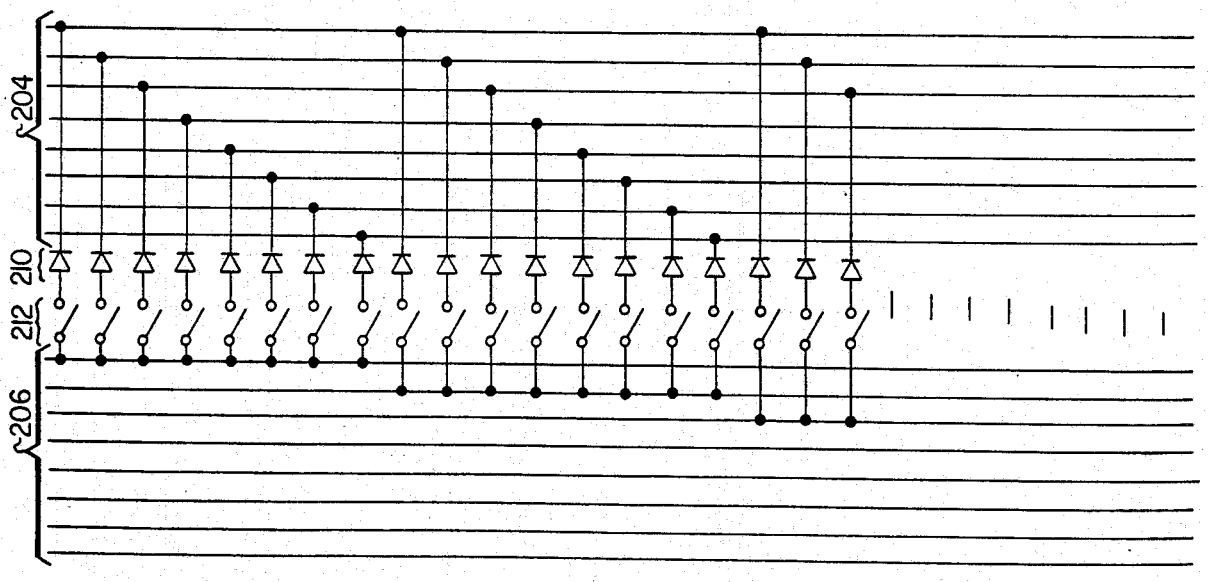
FIG. 7B is a schematic diagram of the switch matrix.

FIG. 7B is a schematic diagram of the matrix array for the microswitches of each of the keyholder housings. As discussed earlier, the switches are actually scanned in a sequential fashion in the preferred embodiment by providing a ground signal on one of lines 204 through diodes 210 to ground the corresponding line one of the 206 line through the switch 212. The grounded line is then detected by the driver card (FIG. 6) by the pulling down of the voltage on one of lines 206.

Figure 8A:
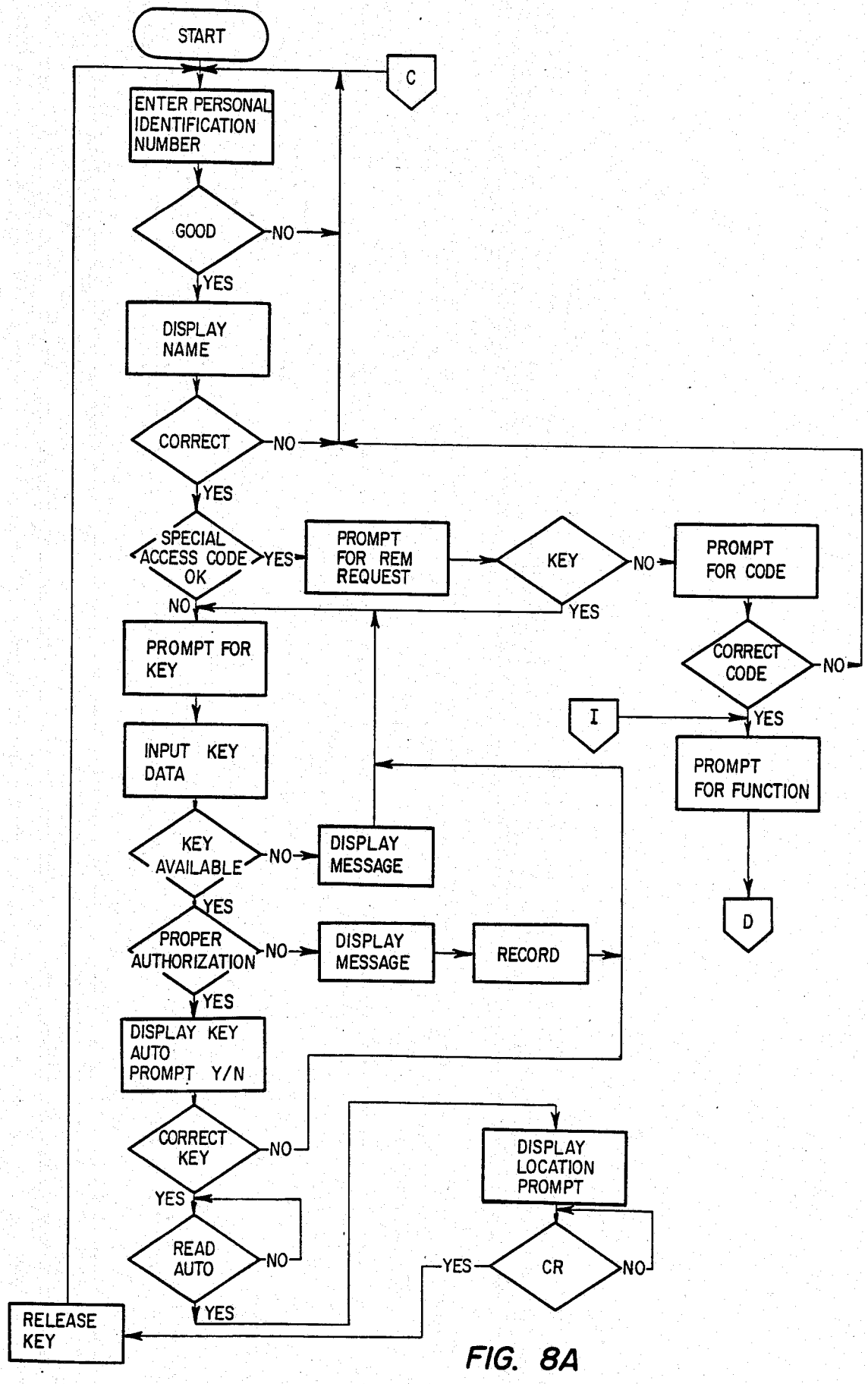
FIG. 8A is a flowchart of the access grant software.

The software contained in the computer in the preferred embodiment is written in "C". FIG. 8A illustrates the initial input program whereby the user would input his or her personal identification code and a special access code. The display would request the key number and then determines if access was authorized from data previously stored. Note that when access is granted a record of the access including the personal identification number, the key number and the access code are recorded.

Figure 8B:
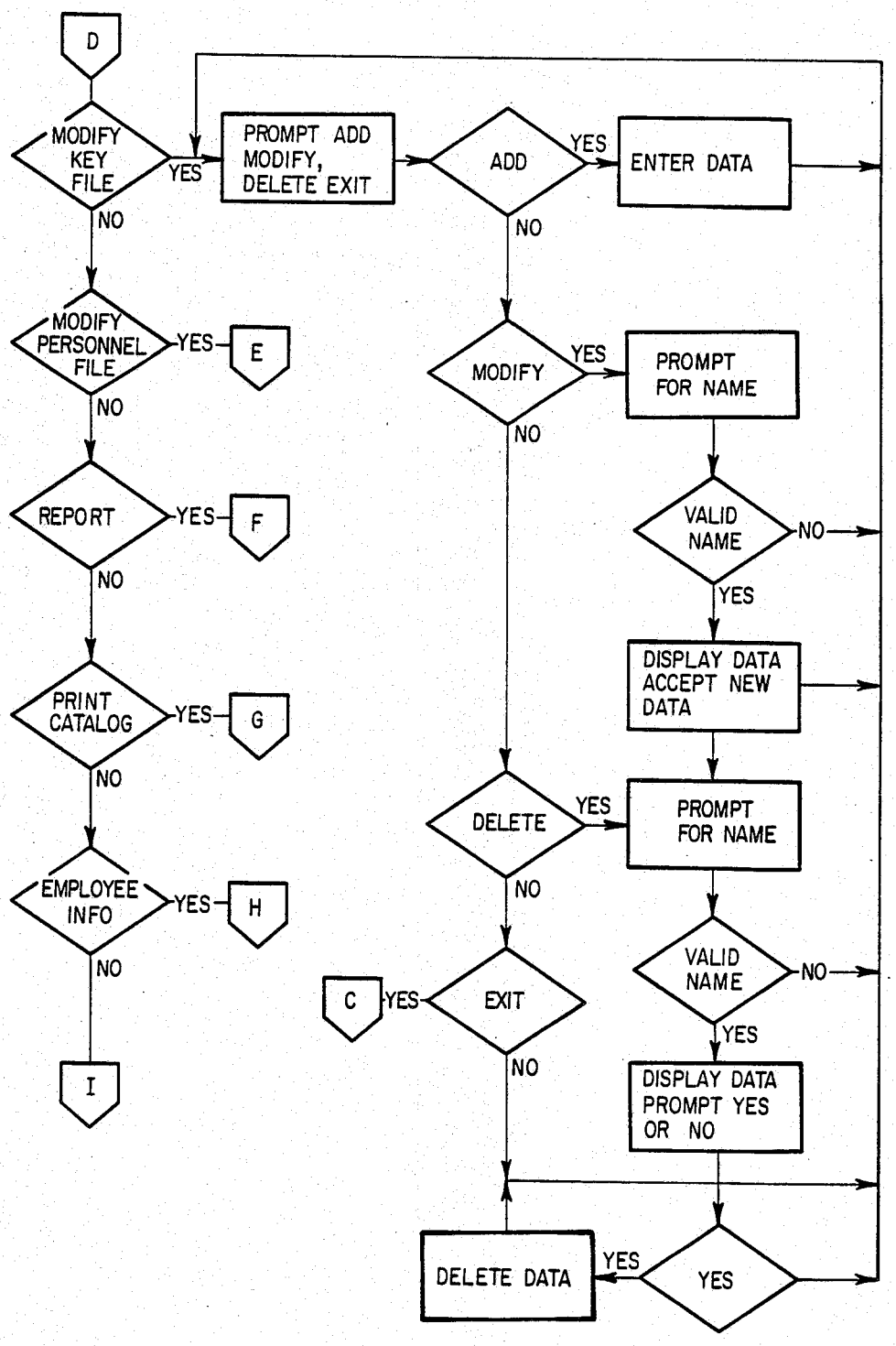
FIG. 8B is a flowchart of the key data input software.

FIG. 8B is a software flowchart of the program portion used to modify the existing key files to add, change or delete key data and to output different file reports.

Figure 8C:
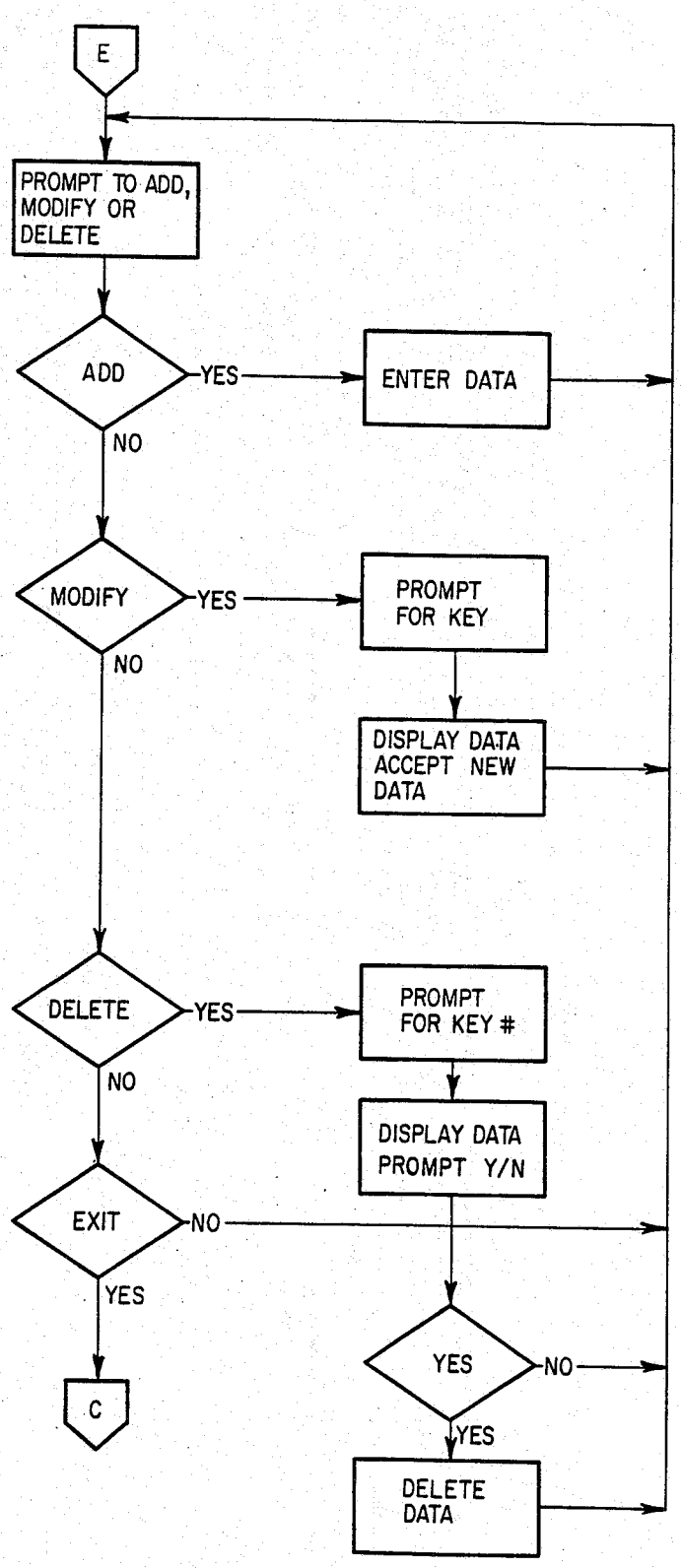
FIG. 8C is a software flowchart of the personnel file input software.

FIG. 8C is a software flowchart of part of the input routine allowing the user to add, modify or delete personnel information.

Figure 8D:
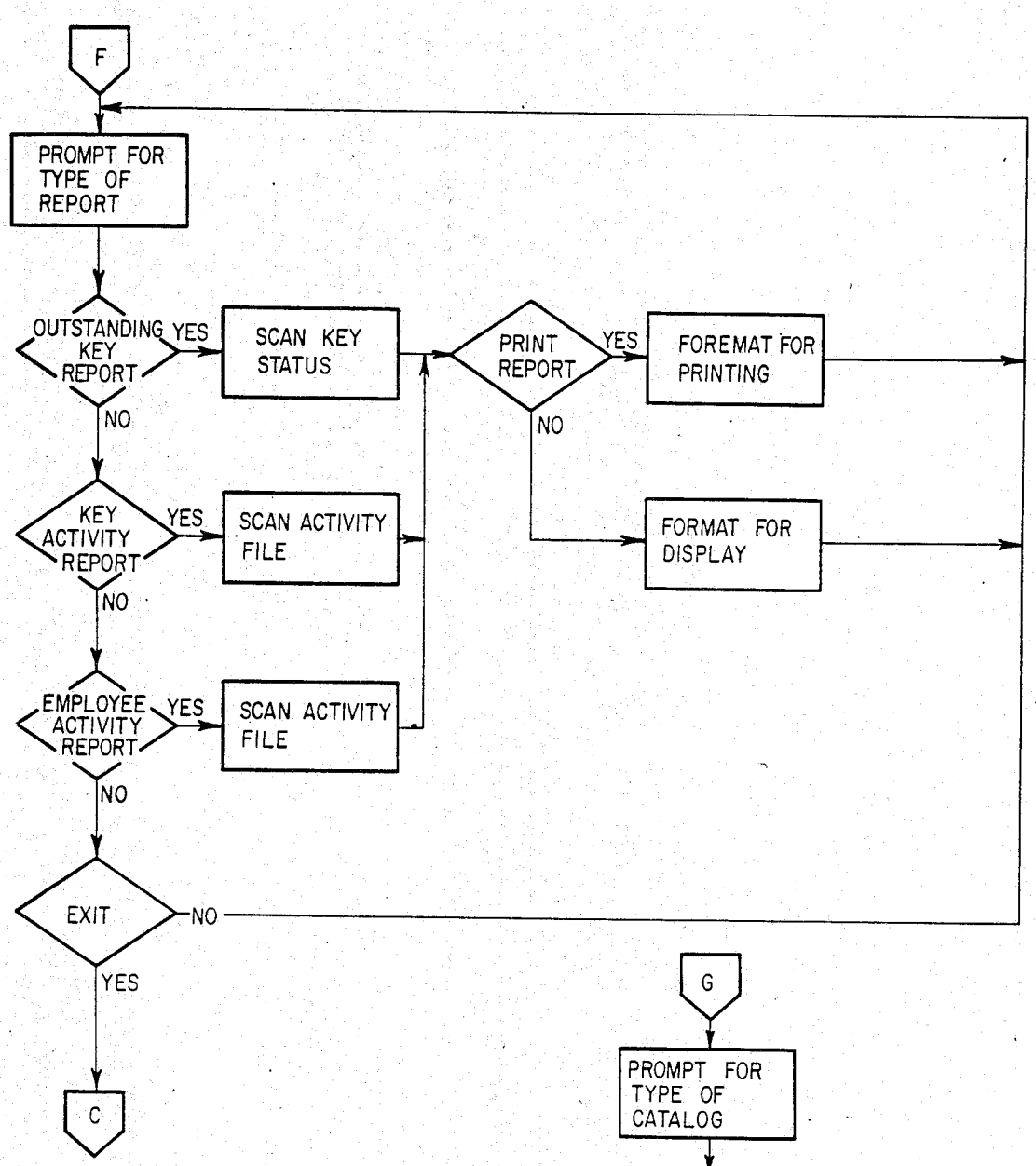
FIG. 8D is a software flowchart for the key report documentation.

FIG. 8D is a software flowchart of the output program that provides reports of outstanding keys, key activity and employee activity.

Figure 8E:
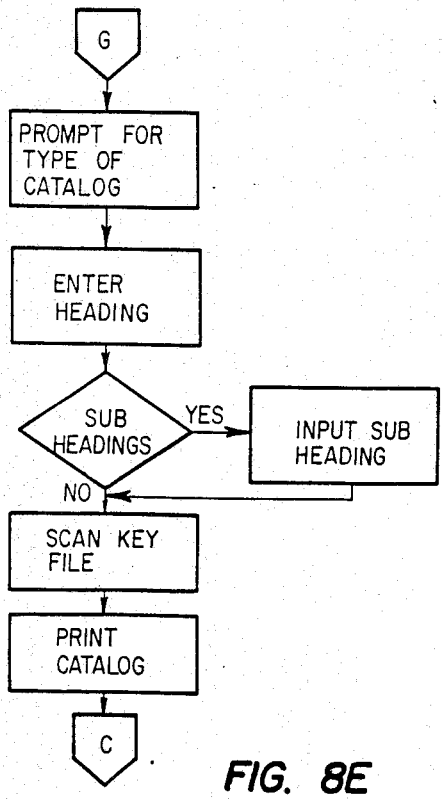
FIG. 8E is a software flowchart for the catalog documentation.

FIG. 8E is a software flowchart of a portion of the output program that provide key catalog data. The key catalog includes the current list of keys logged in the system with their numbers and descriptions.

Figure 8F:
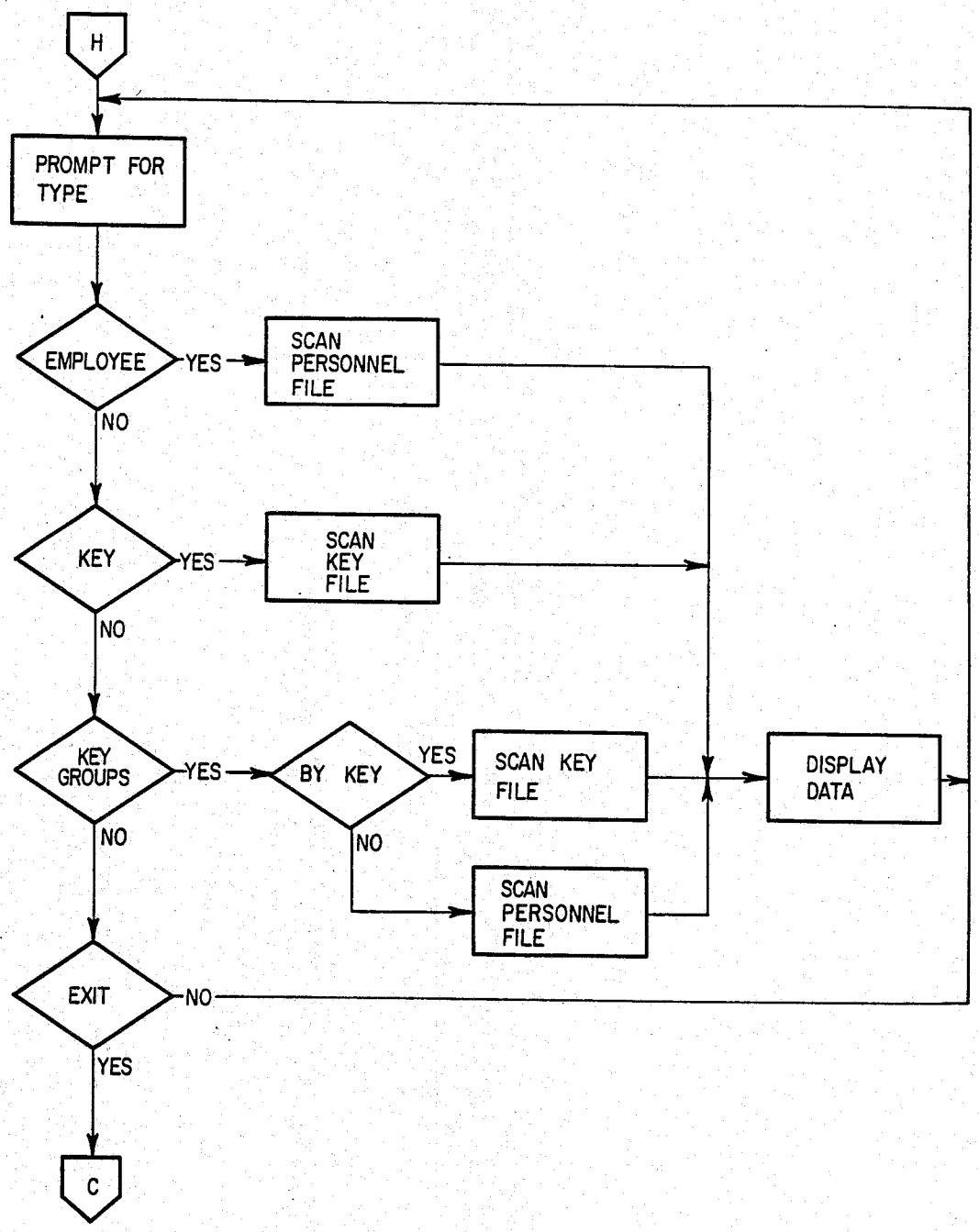
FIG. 8F is a flowchart for the personnel report documentation.

FIG. 8F is a software flowchart of a portion of the output routine that permits scanning of personnel and key files.

Figure 9:
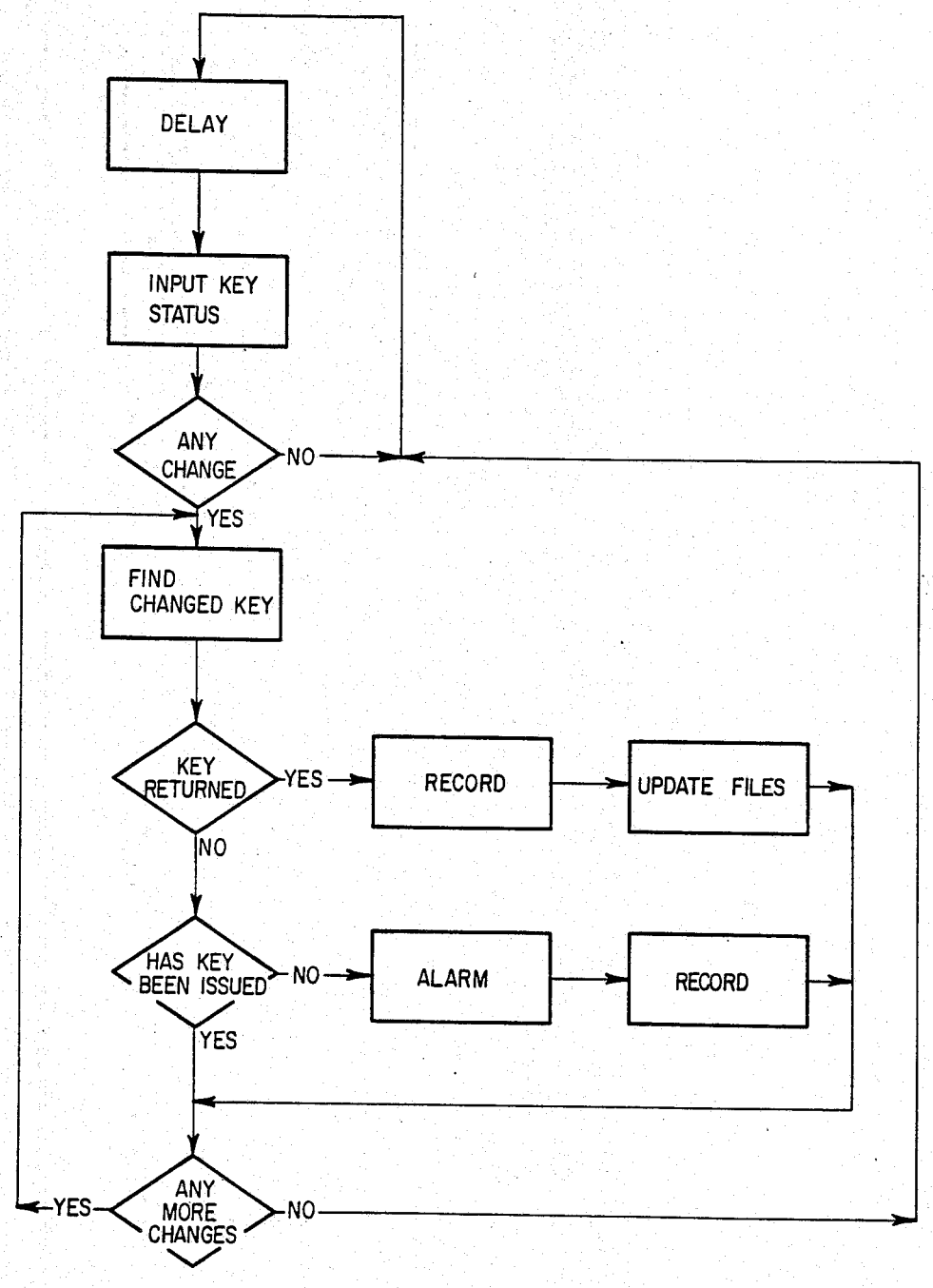
FIG. 9 is a software flowchart for receiving and reporting the return signals.

FIG. 9 is a software flowchart of the program that is used to scan the keyholder housing microswitches to determine when keys have been returned. In the preferred embodiment this program is run periodically and determines when the key status is changed (i.e., when any additional microswitches have been set or reset) and records when the keys have been returned and sounds an alarm when keys have been issued without appropriate access authorization.

In another embodiment of this invention, the keyholders include an identification capability such that any keyholder may be inserted to any slot of a keyholder housing. The keyholder housing includes circuitry to determine the identity of the keyholder. The keyholder identify and keyholder housing address are then provided to the processor for storage and memory. When the system user desires to select a key the system user inputs the keyholder identification to the computer which, from memory, determines which keyholder housing contains that keyholder and, when proper access granted, provides an access signal to the appropriate keyholder partially ejecting the keyholder as previously described.

Figure 10:
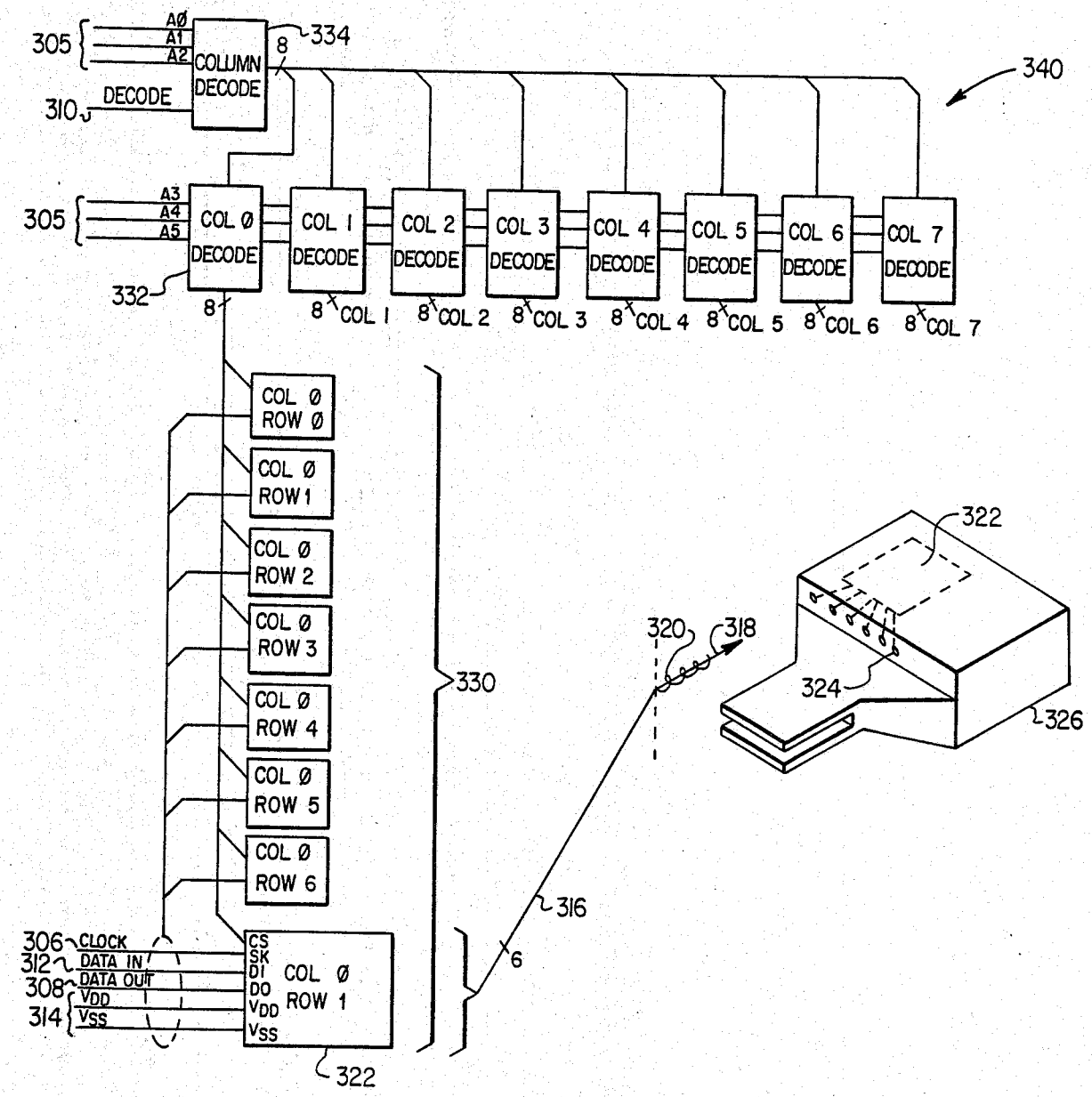
FIG. 10 is a block diagram of the keyholder housing circuits that each interface to a keyholder containing an electronic circuit to provide the keyholder identification.

FIG. 10 illustrates one emodiment where the keyholder includes an electronic circuit embedded therein to provide the keyholder identification data. Specifically, keyholders 326 includes an embedded EEPROM 322 that provides data on 6 pins sockets such as 324 to the 6 pins such as 318. In one embodiment, pin 318 includes spring 320 to provide additional spring loading of the keyholder 326 in the keyholder housing (not shown). In this embodiment, the keyholder housing would be similar to the keyholder housing of FIGS. 2, 3 and 4 with the exception that the microswitch is no longer required and is replaced by circuit 322 which is interfaced to circuitry 330 and 340 provided in the storage cabinet for addressing each individual keyholder housing.

In this preferred embodiment, the electronic circuit 322 is a 16 by 16 array EEPROM from National Semiconductor Part No. NMC9306. Only one 16 bit data word is required for the identification. Data is input and output from this chip in a serial fashion. The circuitry to address the chip 322 of each of the keyholders 326 in the cabinet is provided by circuitry 330 and 340 which is simple column and row decoding circuitry such as used to decode addresses for accessing memory arrays. Specifically, address lines 305 contain address signals A0 through A5. Signals A0 through A2 are column address signals and signals A3 through A5 are row signals. In this embodiment, a decode signal is received on line 310 enabling the column decode circuitry 334 to receive the 3 address lines A0, A1, and A2 of 305 and decode into one of eight lines as shown. In this embodiment, circuit 334 can be any simple demultiplexer demultiplexing 3 lines into 8 accordingly. Circuit 332 which is a row decode circuit, also a simple 3 to 8 demultiplexer, decodes the 3 row address lines A3, A4, and A5 into 1 of 8 lines as shown. The address decoding circuits 334 and 332 select one of the electronic circuits 322 connected to the serial line. The interface to circuit 322 must provide the source and drain voltage 314 and provide a CLOCK signal on line 306 for providing data input (DATAIN) on line 312 and DATA OUTPUT (DATAOUT) on line 308 as shown. These 6 lines are provided via line 316 to the 6 pins such as 318 as previously discussed. Accordingly, each EEPROM circuit 322 may be addressed to determine the identity of the keyholder 326.

Figure 11:
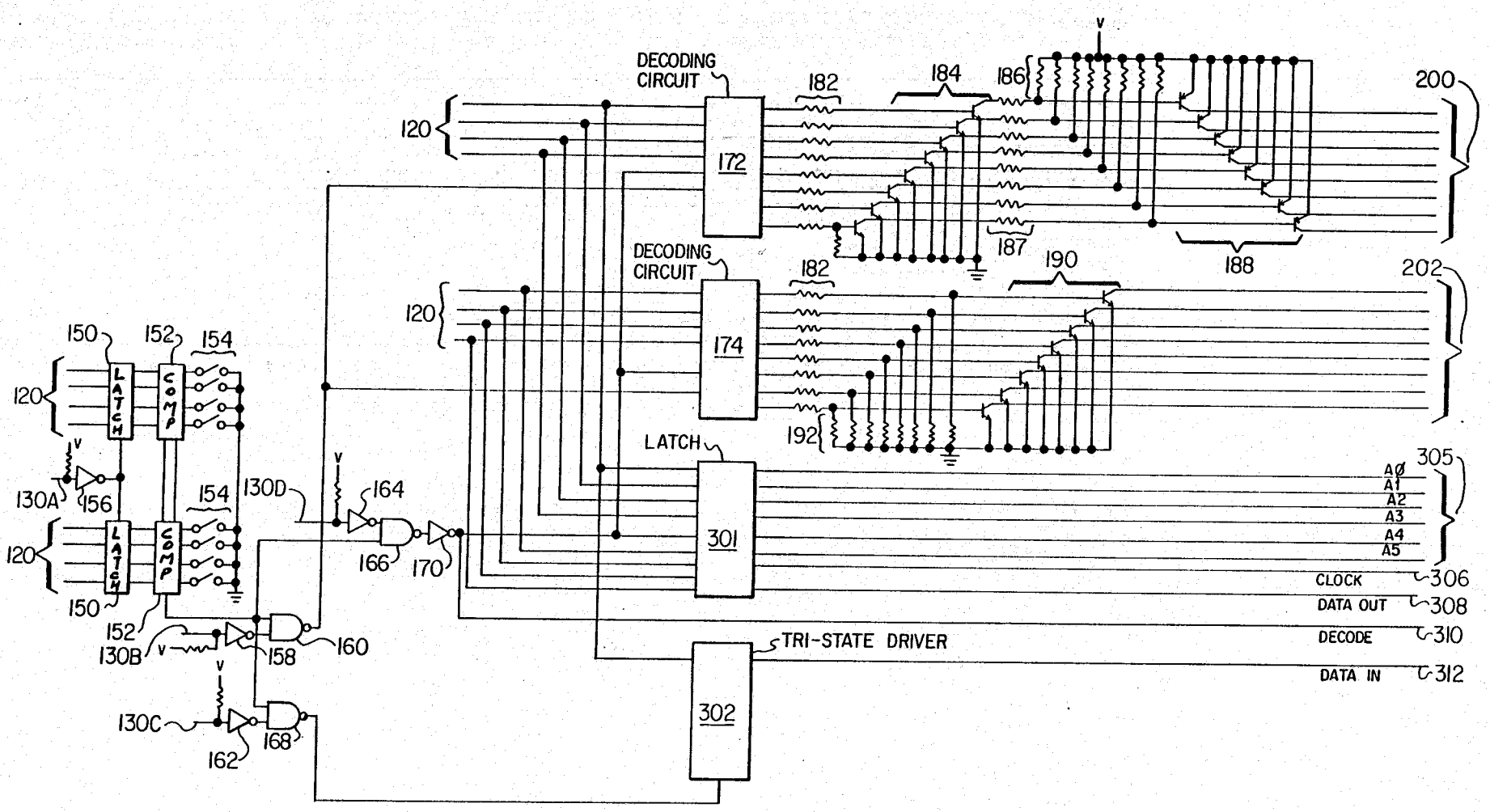
FIG. 11 is a schematic diagram of the driver circuit that interfaces to the keyholder identification circuitry of FIG. 10.

FIG. 11 is a schematic of the driver circuit illustrating the changes required for interfacing to the EEPROM 322. The address lines CLOCK and DATA OUTPUT are provided through an 8 bit latch 301. The decode signal on line 310 is the output of inverter 170 which is also used to control the latch 301. Circuit 302 is merely a tristate driver that receives the data input from line 312 which is provided to the processor as previously discussed.

Figure 12:
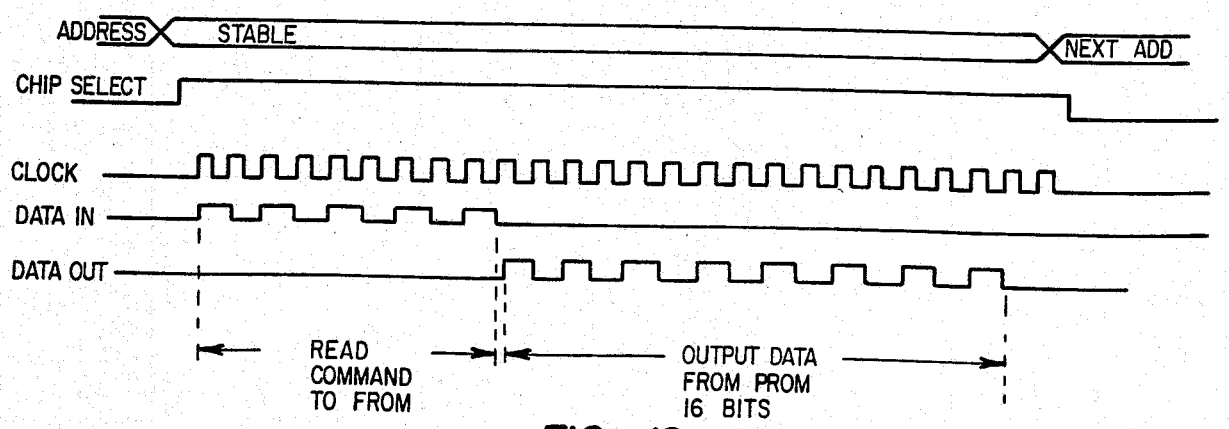
FIG. 12 is a timing diagram of the interface between the processor and the electronic circuitry contained in the keyholder to provide the keyholder identification.

The timing for accessing the identification information is illustrated in FIG. 12. The address is placed on the address lines as shown and is held stable for the whole cycle as is the chip SELECT signal. The CLOCK signal is then used to clock data in which is the READ command for the EEPROM circuit 322. This is followed by an output of the 16 data bits as previously discussed. These 16 data bits contain the identification of the keyholder.

Figure 13:
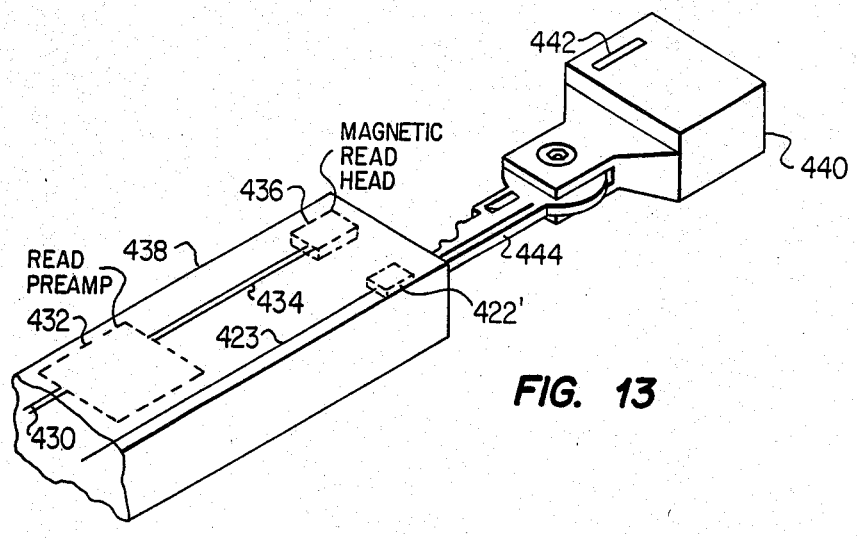
FIG. 13 is a perspective view of a keyholder housing and a keyholder having the identification means contained on a magnetic strip.

FIG. 13 illustrates a further embodiment whereby the identification information is contained on a magnetic strip 422 of the keyholder 440 and key 444. The keyholder housing 438 includes a magnetic read head 436 together with read preamp circuitry 432 and a key entry switch 422 similar to the previous embodiment discussed. In the preferred embodiment, the read preamp circuitry 432 is a Texas Instruments Part No. TL0701 low noise amplifier. The circuit 432 receive the signals from the read head 436 on line 434. The output of the preamp circuitry 432 is then provided on lines 430. In operation when the keyholder 440 is inserted switch 422' will be thrown indicating on the two lines 423 that the read head 436 is to begin reading the magnetic strip 442.

Figure 14:
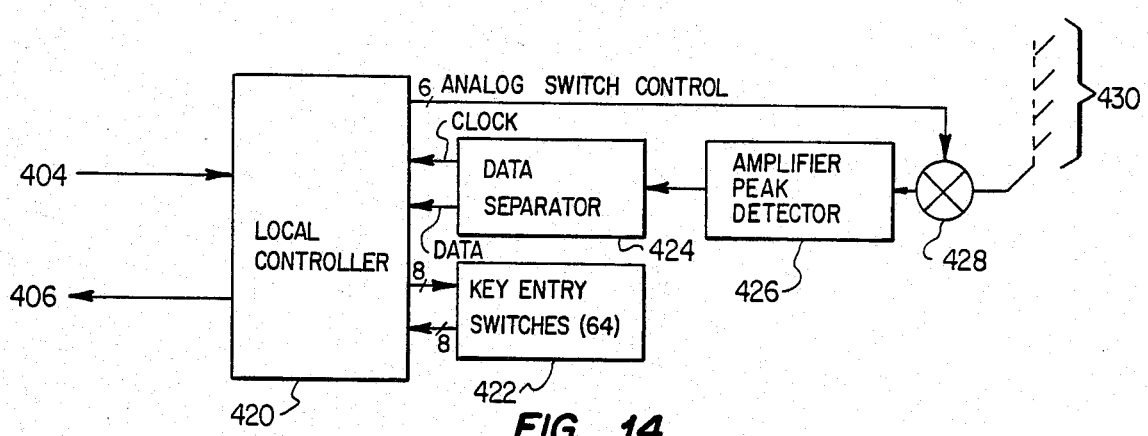
FIG. 14 is a block diagram of the circuitry contained for the keyholder housings to interface with the magnetic strip providing the keyholder identification.

The circuitry for the storage cabinet that interfaces to all the keyholder housings is illustrated in block diagram form in FIG. 14. Specifically, the keys are shown as block 422 providing interface to a local controller 420. When the switch is thrown signifying that a keyholder is being inserted into the keyholder housing, the analog switch 428 is controlled to provide the inputs on one of the lines 430 to the amplifier peak detector circuit 422 through the data separator circuit 424 to the local controller 420 so that the local controller 420 receives the identification contained on the magnetic strip 442 of the keyholder 440. In the preferred embodiment, the amplifier peak detector is a Motorola Part No. MC3740P. The data separator 422 includes a voltage controlled oscillator Exar Part No. XR2212 and a dual one short Part No. 74HC123. Also in this embodiment, the analog switch 428 is a CD4066 analog transmission gate. The local controller 420 is an Intel 8048 controller.

Figure 15:
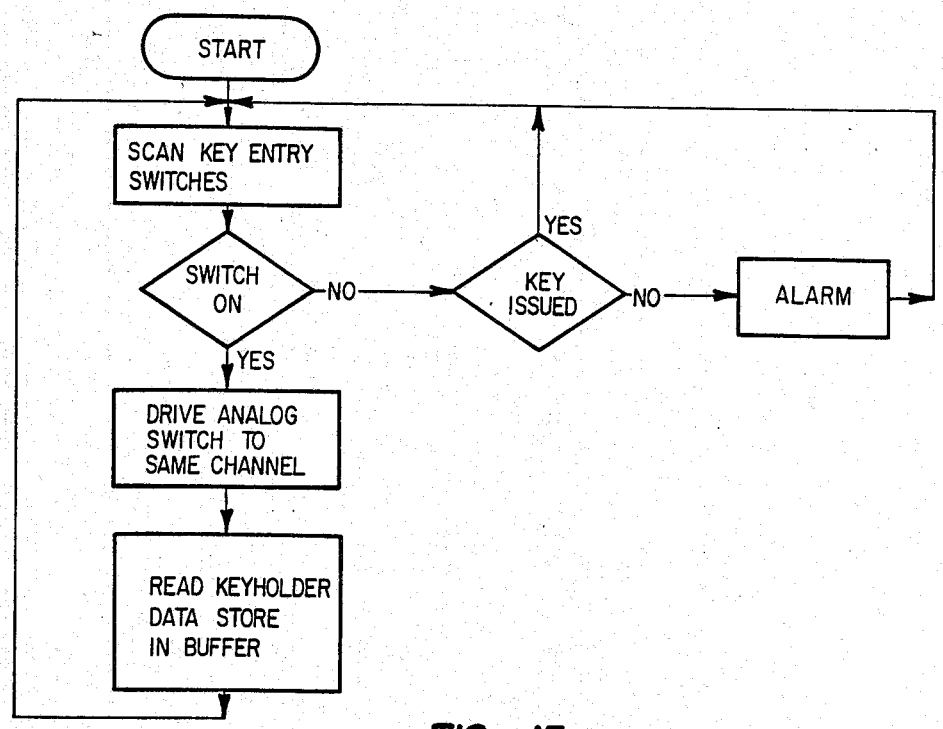
FIG. 15 is a software flowchart for the software executed by the local controller of FIG. 14.

FIG. 15 illustrates a functional software flowchart for the software executed in the local controller 420. The controller scans the key entry switches 422 to determine which keys have been replaced. If a key is missing the local controller determines whether or not the key has been properly accessed and if not an alarm is sounded. When a keyholder is returned, the analog switch is controlled to input the information from that keyholder housing read head. The data is then input and stored in a buffer to be output later to the system processor. The system processor communicates with the local controller 420 on lines 404 (input) and lines 406 (output) as shown.

Figure 16:
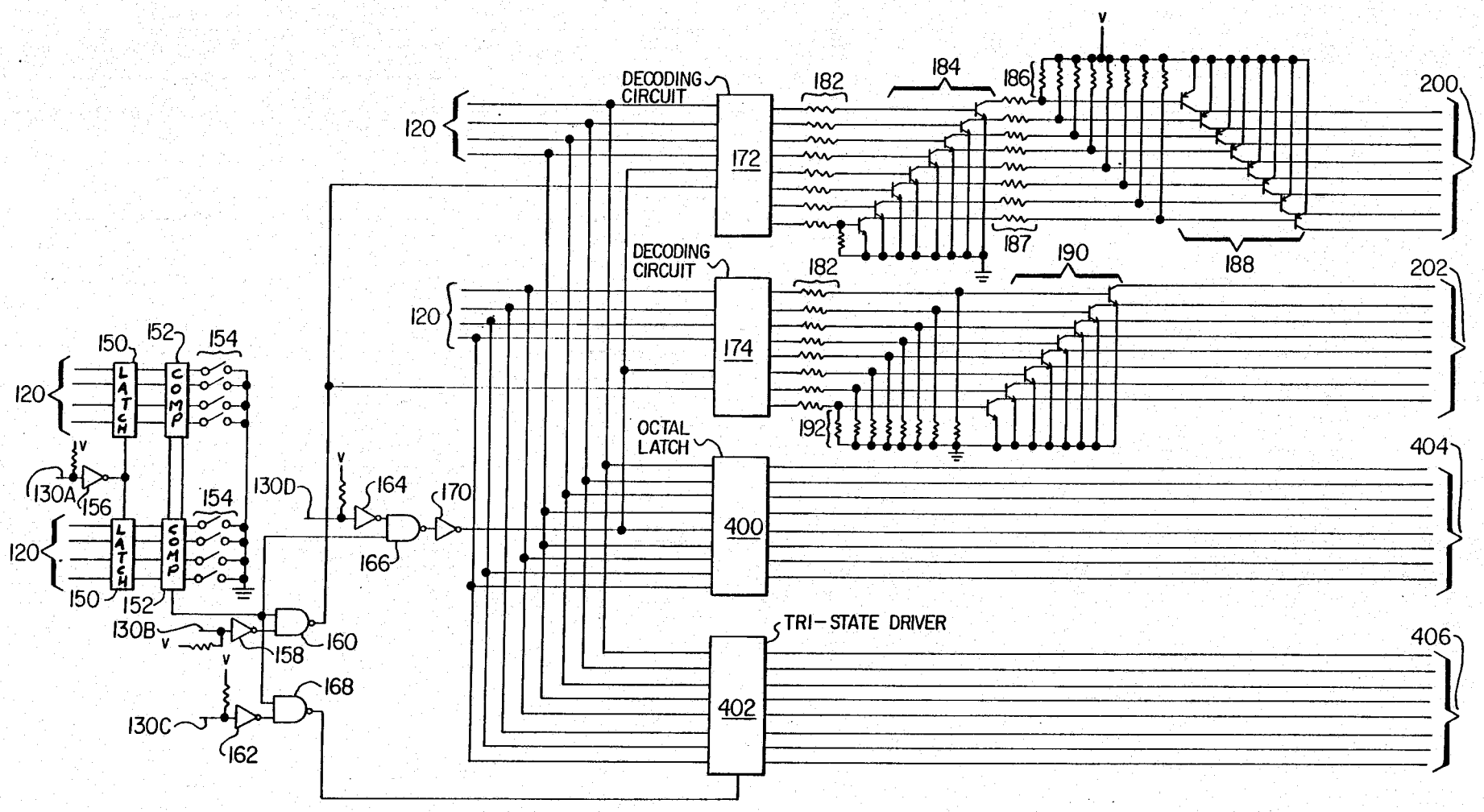
FIG. 16 is a schematic diagram of the drivers circuit that interfaces to the local controller of FIG. 14.

FIG. 16 is the schematic diagram of the driver card configured to interface to the circuitry of FIG. 14. Specifically, the output lines 404 are connected to the address lines 120 through a octal latch 400. The input lines 406 are connected through an octal tristate driver circuit 402 to provide the data on the address lines 120.

The system software previously described would be modified to include the function of interrogating the local controllers for each of the storage cabinets connected to the system processor. However, the scanning function previously performed (i.e. the scanning of the keyholder housing switches) would be performed by the local controllers of each storage cabinet.

Figure 17:
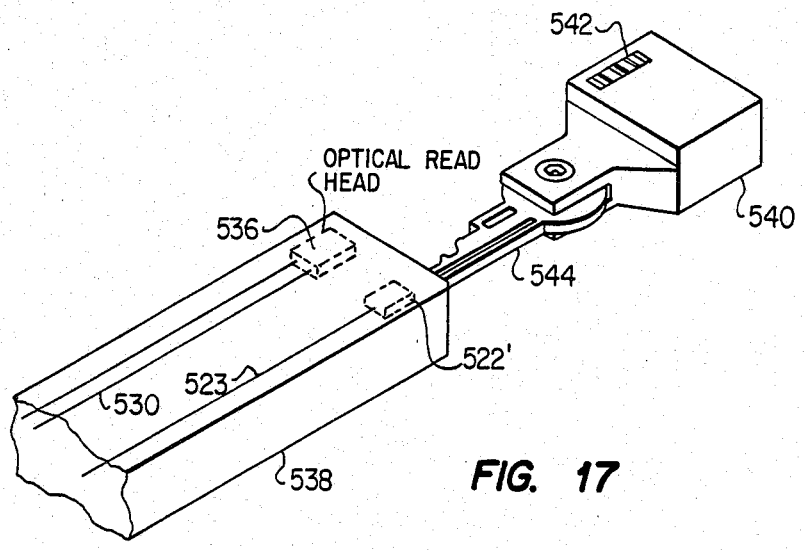
FIG. 17 is a perspective view of a keyholder housing and keyholder having its identificatin contained on an optical strip read by the optical reader within the keyholder housing.

FIG. 17 is an embodiment whereby the keyholder 540 includes an identification code contained on an optical strip 542. When the keyholder 540 containing key 544 is inserted into the keyholder housing 538 the switch 522' is thrown signifying that a keyholder is being placed in a keyholder causing the optical read head 536 to being transmission of the optical code detected from optical strip 542 as the keyholder 540 is inserted.

Again, each storage cabinet includes a local controller 520 connected to an analog switch 528 which in turn is connected to each one of the keyholder housings 538 via data input lines 530 and the key entry switch lines 523. In the embodiment shown the key entry switch circuitry 522 is addressable by 6 of the 8 bits for input and output with the remaining 2 bits of the 8 bits input/output lines used for data. When the key entry switch 522 changes state, the local controller 520, which has been scanning the key entry switches as previously discussed, switches the analog switch to the appropriate position to receive data on lines 530 from the optical read head 536 of the appropriate keyholder housing. The software for the local controller 520 is the same as before to provide the function of scanning and reading the identification data. In this embodiment, the optical read head 536 is a Texas Instrument light emitting diode and photo transistor Part No. TIL149. The amplifier and shaping circuitry 524 which receives the data on lines 530 through analog switch 532 is a preamplifier dual comparator National Part No. LN193.

Figure 18:
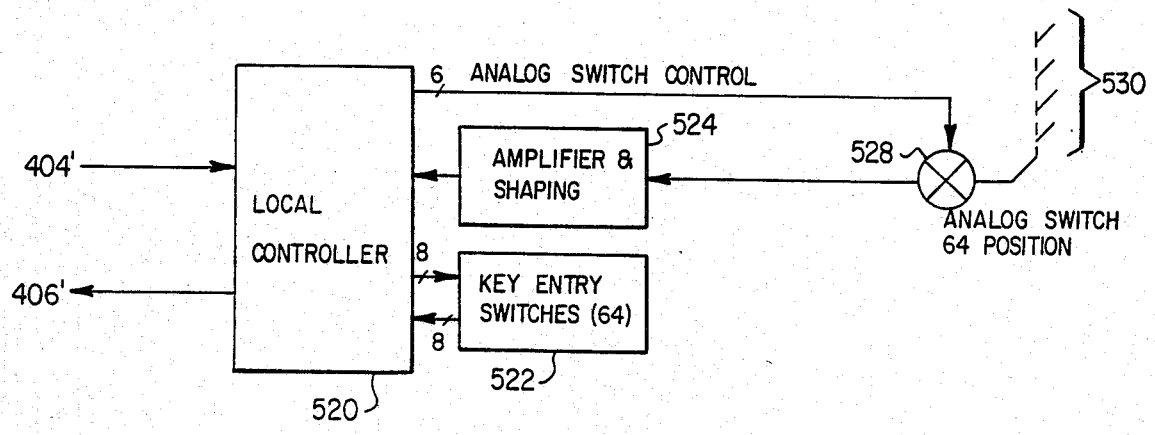
FIG. 18 is a block diagram of the circuitry for interfacing to the keyholder housings and keyholders to provide keyholder identification.

The circuitry of FIG. 18 thus reads the identification code from the optical strip 542 and stores the data in the local controller 520 until read by the system processor as previously discussed for the magnetic strip embodiment. Again, the circuitry of FIG. 16 would be similar for interfacing the driver card to the local controller 520.

Although preferred embodiments of the invention have been described in detail, it is to be understood that various changes, substitutions and alterations can be made therein without departing from the spirit of the invention as defined by the appended claims.

What is claimed is:

1. A system controlling access to a plurality of keys or the like comprising:

a plurality of individual keyholders, each attached to at least one of the keys and including an individually coded mating means for enabling insertion of the holder and key in only a keyholder housing having a corresponding individually coded mating means;

a storage means containing a plurality of the keyholder housings and for controlled storage of the keys and keyholders and including access means for providing access to selected ones of the keys and keyholders in response to an access signal while preventing access to the selected ones of the keys and keyholders in the absence of said access signal and further including means for indicating the return of a key and keyholder to its appropriate keyholder housing;

input means for receiving input data from a system user requesting access to at least one selected key;

display means for providing information to the system user; and processing means connected to the storage means, the input means and the display means for receiving the input data, for providing information to the display means, for determining access from the input date in accordance with stored data, for generating the access signal upon determining a grant of access, for recording the access grant, for receiving the return signal and for recording the return.

2. A system according to claim 1 wherein said mating means and the corresponding mating means includes pins and matching pin sockets.

3. A system according to claim 1 wherein the mating means and the corresponding mating means includes formations on the keyholder and corresponding mating formations are within the keyholder housing.

4. A system according to claim 1 wherein said access means includes a spring loaded latch that is addressably activated by the access signal.

5. A system according to claim 4 wherein said storage means includes a switch which provides the return signal when the keyholder and key are inserted into the matching keyholder housing.

6. A system according to claim 1 wherein said processing means further includes an alarm which is activated when removal of any keyholders and keys are attempted without a grant of access.

7. An apparatus for controlling access to a plurality of similarly shaped objects comprising:

a plurality of individual object holder means, each for physical attachment to at least one of the objects and including an individually coded mating means for enabling storage of the holder means and object only in a holder housing having a corresponding individually coded mating means; and a storage means containing a plurality of the holder housings and for controlling storage of the holder means and objects and including means for providing access to selected ones of the holder means and attached objects in response to an authorization signal while preventing access to the selected ones of the holder means and attached objects in the absence of said authorization signal.

8. An apparatus according to claim 7 wherein said mating means and the corresponding mating means includes pins and matingly matching pin sockets.

9. An apparatus according to claim 8 wherein the mating means and the corresponding mating means includes formations upon the holder and correspondingly mating formations upon the holder housing.

10. An apparatus according to claim 9 wherein said formations include tongues formed upon the holder surface and corresponding grooves formed within the holder housing surface providing for mating of the tongues and grooves when the appropriate holder is inserted in the holder housing.

11. A system for controlling access to a plurality of similarly shaped objects comprising:

a storage means for storing a plurality of said objects, for providing access to selected one of said objects in response to an access signal while preventing access to the selected ones of said objects in the absence of said access signal, and for providing a return signal when an accessed object is returned to the storage means; and data processing means connected to said storage means and including an input means for receiving input data from a system user, said data processing means being operative for determining access to selected one of the objects in response to the input data and stored data and when access is determined providing said access signal. for receiving said return signal and for recording grant of access and occurrence of return of accessed objects.

12. A system according to claim 11 wherein said storage means includes access means having a spring loaded latch that is addressably activated by the access signal.

13. A system according to claim 12 wherein said storage means further includes a switch which provides the return signal when the accessed object is returned.

14. A system according to claim 13 wherein said data processing means further includes an alarm circuit to provide an alarm when removal of any objects are attempted without access being granted.

15. An apparatus for managing distribution of a plurality of similarly shaped objects comprising:

a plurality of individual object holder means, each for attachment to at least one of the objects and for providing an individually coded identification; and a plurality of holder housing means, each for controlling the storage of a holder means and attached objects and including identification reading means for determining the holder means identity and including means for providing access to the holder means when selected while preventing access to the holder means when not selected.

16. An apparatus according to claim 15 further including a storage cabinet to contain the plurality of holder housing means and including address means for addressing each holder housing for determining the holder identification and for providing access.

17. An apparatus according to claim 15 wherein said holder means includes a magnetic encoded means for providing the holder identification.

18. An apparatus according to claim 15 wherein said holder means includes an optically encoded means for providing the holder identification.

19. An apparatus according to claim 15 wherein said holder means includes an electronic circuit means for providing the holder identification.

20. A system for controlling access to a plurality of keys or the like comprising:

a plurality of individual keyholders, each attached to at least one of the keys and included means for providing a unique keyholder identification;

a plurality of keyholder housings including means for controlled storage of the keys and keyholders and including means for determining the keyholder identification when the keyholder is inserted therein, including access means for providing access to the keyholder in response to an access signal while preventing access to the keyholder in the absence of said access signal;

input means for receiving input data from a system user requesting access to at least one selected key;

display means for providing information to the system user; and processor means connected to the plurality of keyholder housings, the input means and the display means for receiving the input date, for providing information to the display means, for determining access from the input in accordance with stored data, for recording the keyholder identification of keyholders within each of the keyholder housings for generating the access signal to the appropriate keyholder housing upon determining a grant of access and for recording the access grant.

21. A system according to claim 20 wherein said holder means includes a magnetic encoded means for providing the holder identification.

22. A system according to claim 20 wherein said holder means includes an optically encoded means for providing the holder identification.

23. A system according to claim 20 wherein said holder means includes an electronic circuit means for providing the holder identification.

24. A system for managing distribution of a plurality of similarly shaped objects comprising:

code means providing individual identification for each of the objects subject to distribution;

storage means for containing a plurality of the objects and operable to receive the objects and to dispense the objects selectively on receipt of a predetermined control signal while withholding dispensing of the objects in the absence of receiving said predetermined control signal; and reading means capable of reading the individual object identifications of said code means and for emitting said control signal to said storage means to dispense a selected one of the objects when authorization access to said storage means has been determined.

25. A system apparatus according to claim 24 in which said reading means includes data processing means connected to said storage means and including an input means for receiving input data from a system user, said data processing means being operative for determining access to selected ones of the objects in response to the input data and stored data and, when authorization access has been determined, providing said control signal.

* * * * *

UNITED STATES PATENT AND TRADEMARK OFFICE

CERTIFICATE OF CORRECTION

PATENT NO. : 4,661,806

DATED : April 28, 1987

INVENTOR(S) : Gilbert A. Peters and J. Brooks Mitchell

It is certified that error appears in the above-identified patent and that said Letters Patent is hereby corrected as shown below:

Column 1, line 35, "3,405,369" should be --2,405,369--.

Column 2, line 60, "an alarm any keyholders" should be --an alarm when any keyholders--.

Colum 5, line 4, "located" should be --location--.

Signed and Sealed this

Twenty-fifth Day of August, 1987

*Attest:*

DONALD J. QUIGG

*Attesting Officer*

*Commissioner of Patents and Trademarks*